US006951046B2

(12) United States Patent
Robinson

(10) Patent No.: US 6,951,046 B2
(45) Date of Patent: Oct. 4, 2005

(54) HAND PRESSURE ABATEMENT APPARATUS FOR USE WITH A POWER TOOL

(76) Inventor: Josh M. Robinson, 7252 W. County Rd. 24H, Loveland, CO (US) 80538

( * ) Notice: Subject to any disclaimer, the term of this patent is extended or adjusted under 35 U.S.C. 154(b) by 0 days.

(21) Appl. No.: 10/377,187

(22) Filed: Feb. 28, 2003

(65) Prior Publication Data

US 2003/0159251 A1 Aug. 28, 2003

Related U.S. Application Data

(60) Provisional application No. 60/360,590, filed on Feb. 28, 2002.

(51) Int. Cl.[7] ..... A45C 13/22
(52) U.S. Cl. ..... 16/431; 16/430
(58) Field of Search ..... 16/DIG. 12, 430, 16/431, 435

(56) References Cited

U.S. PATENT DOCUMENTS

| | | | | | |
|---|---|---|---|---|---|
| 3,739,932 | A | * | 6/1973 | Westover | 215/396 |
| 4,023,430 | A | | 5/1977 | Imamura | 74/412 |
| 4,140,446 | A | | 2/1979 | Fernstrom et al. | 418/270 |
| 4,277,063 | A | * | 7/1981 | Perrone et al. | 473/538 |
| 4,374,439 | A | | 2/1983 | Norman | 2/161 |
| 4,383,336 | A | | 5/1983 | Beckman et al. | 2/158 |
| 4,458,416 | A | | 7/1984 | Hansson et al. | 30/168 |
| 4,624,016 | A | | 11/1986 | Leuvano | 2/161 A |
| 4,632,103 | A | | 12/1986 | Fabricant et al. | 128/157 |
| 4,651,350 | A | | 3/1987 | Dawiedczyk | 2/158 |
| 4,691,387 | A | | 9/1987 | Lopez | 2/161 |
| 4,779,289 | A | | 10/1988 | Prouty | 2/161 |
| 4,808,469 | A | | 2/1989 | Hiles | 428/318.6 |
| 4,825,548 | A | | 5/1989 | Driggers | 30/276 |
| 5,027,910 | A | | 7/1991 | Honsa et al. | 173/162.2 |
| 5,031,640 | A | | 7/1991 | Spitzer | 128/878 |
| 5,050,596 | A | | 9/1991 | Walasek et al. | 128/381 |
| 5,054,562 | A | | 10/1991 | Honsa et al. | 173/139 |
| 5,150,475 | A | | 9/1992 | Hansen et al. | 2/16 |
| D341,424 | S | | 11/1993 | Lurie | D24/189 |
| 5,257,418 | A | | 11/1993 | Jaskiewicz | 2/20 |
| 5,285,529 | A | | 2/1994 | Arena | 2/20 |
| 5,329,638 | A | | 7/1994 | Hansen et al. | 2/16 |
| 5,330,249 | A | | 7/1994 | Weber et al. | 297/214 |
| 5,347,684 | A | * | 9/1994 | Jackson | 16/421 |
| 5,365,637 | A | | 11/1994 | Bodell et al. | 16/116 |
| D362,914 | S | | 10/1995 | Mann | D24/190 |
| 5,469,601 | A | * | 11/1995 | Jackson | 16/421 |
| 5,575,051 | A | | 11/1996 | Moore | 29/243.523 |
| 5,581,809 | A | | 12/1996 | Mah | 2/20 |
| 5,607,023 | A | | 3/1997 | Palm | 173/178 |
| 5,632,045 | A | | 5/1997 | Chase et al. | 2/161.6 |
| 5,640,712 | A | | 6/1997 | Hansen et al. | 2/20 |
| 5,653,643 | A | | 8/1997 | Falone et al. | 473/300 |
| 5,666,667 | A | | 9/1997 | Hook, Jr. | 2/159 |
| D387,503 | S | | 12/1997 | Ho | D29/113 |
| 5,829,061 | A | | 11/1998 | Visgil et al. | 2/161.6 |
| 5,867,868 | A | * | 2/1999 | Ward | 16/422 |
| 5,933,868 | A | | 8/1999 | Bender | 2/161.1 |
| 5,975,862 | A | | 11/1999 | Arahata et al. | 417/234 |
| 6,161,256 | A | * | 12/2000 | Quiring et al. | 16/431 |
| D463,566 | S | | 9/2002 | Slautterback | D24/190 |
| D465,617 | S | | 11/2002 | DeLaup | D29/113 |
| D468,434 | S | | 1/2003 | Slaughterback | D24/190 |
| 6,671,931 | B1 | * | 1/2004 | Duncan | 16/435 |

* cited by examiner

*Primary Examiner*—John B. Walsh
(74) *Attorney, Agent, or Firm*—Santangelo Law Offices, P.O.

(57) ABSTRACT

A power tool user pressure abatement system may include a soft, cushioning material configurable to a tool such as a power tool, including a power drill, such that the material remains in position between the tool and a user's contacting hand, thereby minimizing impact forces and pressures imparted during tool use. In at least one embodiment, a unitary piece of cushioning material such as neoprene may be cut or slit appropriately in order to facilitate quick placement of the material onto the tool, retention of the material in an effective position during tool use, and quick removal thereof. Associated methods are also disclosed.

6 Claims, 7 Drawing Sheets

Top View

Side View

Bottom View

HAND PRESSURE ABATEMENT APPARATUS FOR USE WITH A POWER TOOL

CROSS-REFERENCES TO RELATED APPLICATIONS

This application claims the benefit of and priority from U.S. Provisional Application 60/360,590, filed Feb. 28, 2002, entitled "Power Tool Comfort Pad", hereby incorporated by reference.

BACKGROUND

The present invention relates to a comfort pad or what may more generally be termed a hand pressure abatement apparatus, and more particularly to a hand pressure abatement apparatus that can be readily applied to and usable on a power tool such as but not limited to a drill, including cordless and corded drills, providing hand pressure abatement and possibly also comfort to the hand and/or other tool contacting body part during operation of the power tool.

The design of many power tools, including drills (cordless and otherwise) is such that during use, pressure on the hand (i.e., hand pressure) can become excessive and uncomfortable, especially after a lengthy period of operational use. This is particularly true due to the continual and/or repetitive nature of the tasks performed by power tools, such as in the case of drilling, and the resultant forces imparted to a body part of a user, such as a hand, that may be in contact with the tool. Excessive hand pressure may also result from one-time receipt or experience of dynamic impact forces during tool use. Whether such pressures experienced by a tool operator result from static or dynamic forces, there is a need for pressure abatement apparatus. Indeed, there is no known user removable pad on the market that addresses this issue of hand pressure abatement and comfort, yet there is a definite need for such an apparatus.

SUMMARY OF THE INVENTION

In one basic form, the present invention discloses the use of a power tool user impact force abatement or pressure abatement apparatus that may be constructed from a cushiony material such as neoprene, for example, and designed so as to be configurable over a part of a power or other tool or implement such that it remains in a position between the power tool and the part of the user that contacts the power tool (such as a hand) during operation of the tool.

It is therefore an objective of this invention to provide a hand pressure abatement apparatus that can provide relief to the power tool user's hand or other contacting body part during power tool use An additional objective is to provide a hand pressure abatement apparatus that can be readily applied and easily removed from a power tool such as a power drill.

A further objective is to provide a hand pressure abatement apparatus that is not cumbersome and will not interfere in the operation of the power tool (e.g., a power drill).

A further objective is to provide a hand pressure abatement apparatus that has at least one embodiment in which there is only one part.

A further objective is to provide a hand pressure abatement apparatus that has at least one embodiment in which the entire apparatus may be placed in a small area (such as a tool operator's pants pocket or tool box) for storage or transportation.

Still a further objective is to provide one hand pressure abatement apparatus that can be universally used on most all types of a certain power tool, such as a power drill, whether corded or cordless.

A final objective is to provide a hand pressure abatement apparatus that is inexpensive and durable.

In summary, the hand pressure abatement apparatus provides a safe, easily-applied, reliable, functional, and needed addition to the power tool market, including the power drill (both corded and cordless) market.

BRIEF DESCRIPTION OF THE DRAWINGS

These and other objectives will become more apparent after referring to the following specifications and attached drawings, which show only examples of the inventive technology and are not to be construed in any way as limiting the breadth of the claims.

DETAILED DESCRIPTION OF THE PREFERRED EMBODIMENTS

Figure 1:
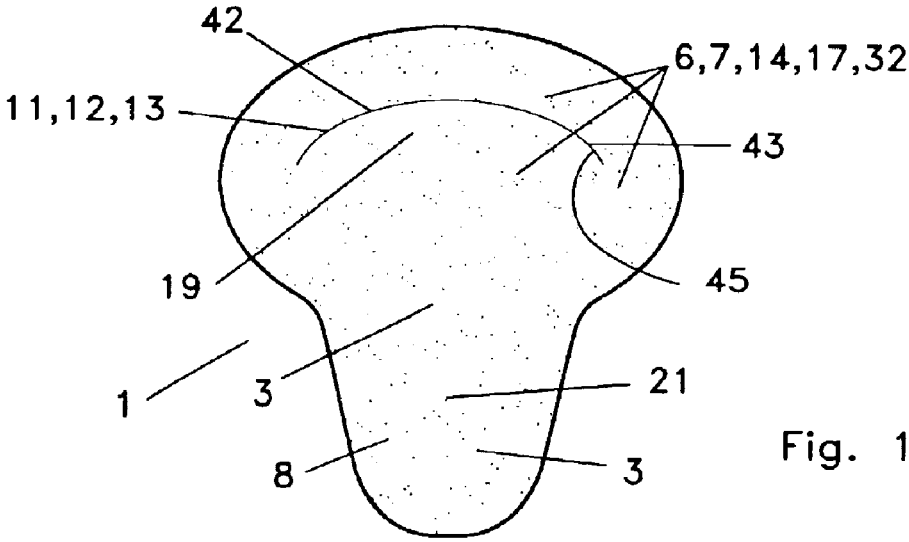
FIG. 1 is a front view of an embodiment of a hand pressure abatement apparatus in a disengaged configuration.
Figure 2:
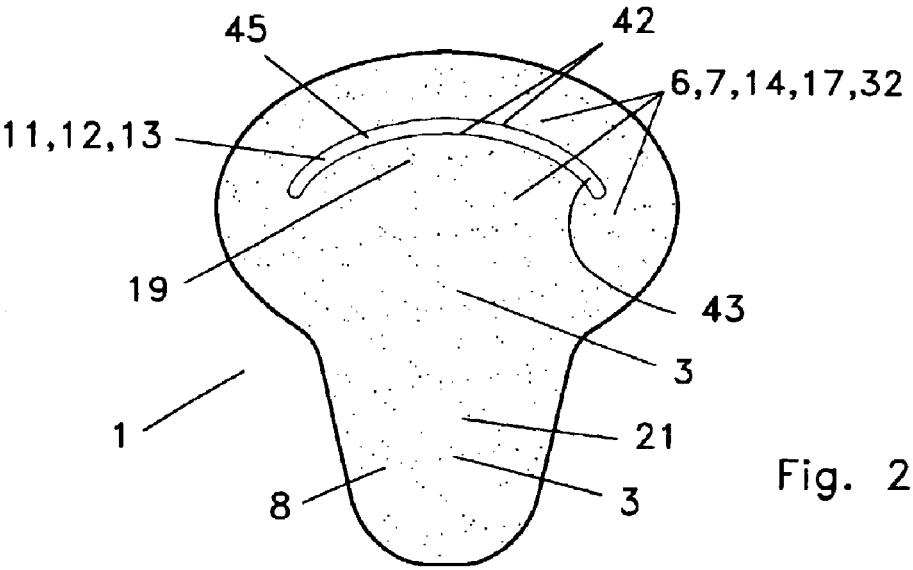
FIG. 2 is a front view of an embodiment of a hand pressure abatement apparatus in a disengaged configuration.

In at least one embodiment, a hand pressure abatement apparatus 1 may be usable on a power tool 2 and may comprise (a) a hand pressure abatement pad 3 that is adapted for placement on a power tool surface 4 so that during operation of the power, the hand pressure abatement pad is established between the power tool surface and at least a portion of a power tool operator's hand; and (b) a retention element 6 (which may be a user engageable, user disengageable retention element 7) to which the hand pressure abatement pad is responsive; and that enables disengageable retention of the hand pressure abatement pad on the power tool surface during operation of the power tool.

In reference to FIGS. 1–6 and 10–14, the basic shape of several different embodiments of the hand pressure abatement apparatus is shown. In one embodiment, the hand pressure abatement apparatus or apparatus may be constructed out of neoprene or may be made from any cushioning material 8, including those that are soft, rubbery, compressible and/or resilient. It may be a gel impregnated or gel encapsulating material, or perhaps will not incorporate any gel material. It may be made in a variety of widths, ranging from 1–5 mm, as but one example, which width range may provide the greatest amount of pressure abatement without becoming cumbersome. In at least one embodiment, the outer side 9 of at least part of the hand pressure abatement apparatus may include an elastic type fabric material such as, for example, lycra®, to increase comfort and durability of the pad. That added material (or simply the hand pressure abatement apparatus itself) may also help keep the user's hand (or other body part that contacts the power tool) dry, thus helping to prevent accidents attributable to slippage of the power tool during usage. The inner and/or the outer surface of the pad may be a type of "grippy" cushioning 10 (such as some type of rubberized material) to reduce slippage during use.

As shown in FIGS. 1–6 and 10, and FIGS. 15–17, a slit 11, or more generally, an opening 12 that, in at least one embodiment, is arc shaped 13, may be cut in material(s) to create a retention band 14 that may retentively surround a part 15 of a power tool, such as a drill 16, for example, as shown (see, e.g., FIGS. 15–17), thereby enabling retention of the hand pressure abatement pad. This retention band may be continuous 17 (see, e.g., FIGS. 1–3) or discontinuous 18 (see, e.g., FIGS. 4–6). The hand pressure abatement pad may comprise part of the user engageable, user disengageable retention element (e.g., a retention band). Thus, a part 19 of the hand pressure abatement pad may be part of the user engageable, user disengageable retention element (e.g., the retention band); this part of the hand pressure abatement pad may also serve to abate or mitigate pressure experienced by the upper part of the hand (here, the term upper is used in reference to a typical hand position while operating a power tool such as a drill in a horizontal position) that grasps a power tool. This can also be seen in FIGS. 15–16, with specific use on a drill. The basic shape also provides a lower portion 21 (again, lower is used with regard to a hand pressure abatement apparatus engaged on a power tool that is operated in a horizontal position, e.g.) which is the portion of the pad that may protect the palm area. The figures depict only a few embodiments—other hand pressure abatement apparatus shapes are also contemplated by the invention.

The user engageable, user disengageable retention element may be any element that is usable to somehow retain the hand pressure abatement pad on a power tool surface during operation of the power tool, and is also engageable and disengageable by a tool operator or user. Of course engageable means that the retention element can be made to retain an element (such as the hand pressure abatement pad) and disengageable means that the retention element can be caused to not retain an element (again, such as the hand pressure abatement pad). In at least one embodiment, as where the hand pressure abatement apparatus is to be used on a reciprocating saw 23 or a circular saw (as but two examples), there may be a need to retain the retention band itself so that the retention band stays in the proper (or preferred retention) position 24 on the tool and thus can adequately retain the hand pressure abatement pad. This may be accomplished through the use of a retention band retention element 25, which may be, e.g., a Velcro strap 26 that is usable to surround part of the retention band and part of the power tool. Other tools on which the hand pressure abatement apparatus may be used (and that may or may not be benefited from the use of a retention band retention element) are a power drill, an air hammer, an air nail gun, and a sixteen penny gun, to name a few. Indeed, the user of almost any type of hand operated power tool might benefit from the use of a hand pressure abatement apparatus on the tool during operation. It is also possible that users of hand operated tools that are not electrically powered (such as a hand saw) would benefit from use of the hand pressure abatement apparatus during operation of the tool.

Figure 15:
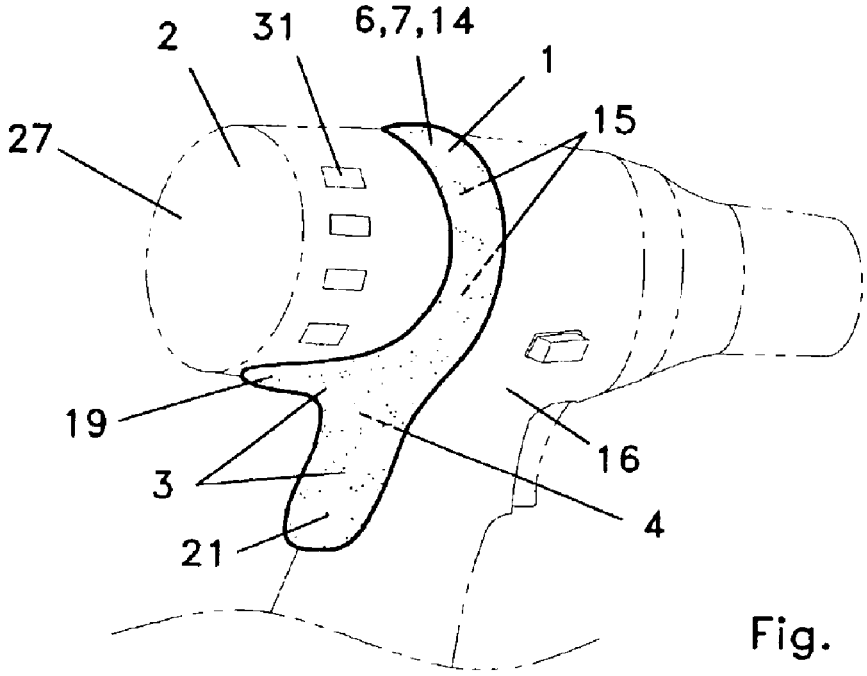
FIG. 15 is a perspective view of an embodiment of the invention showing its engaged configuration position on a cordless power drill during use.
Figure 16:
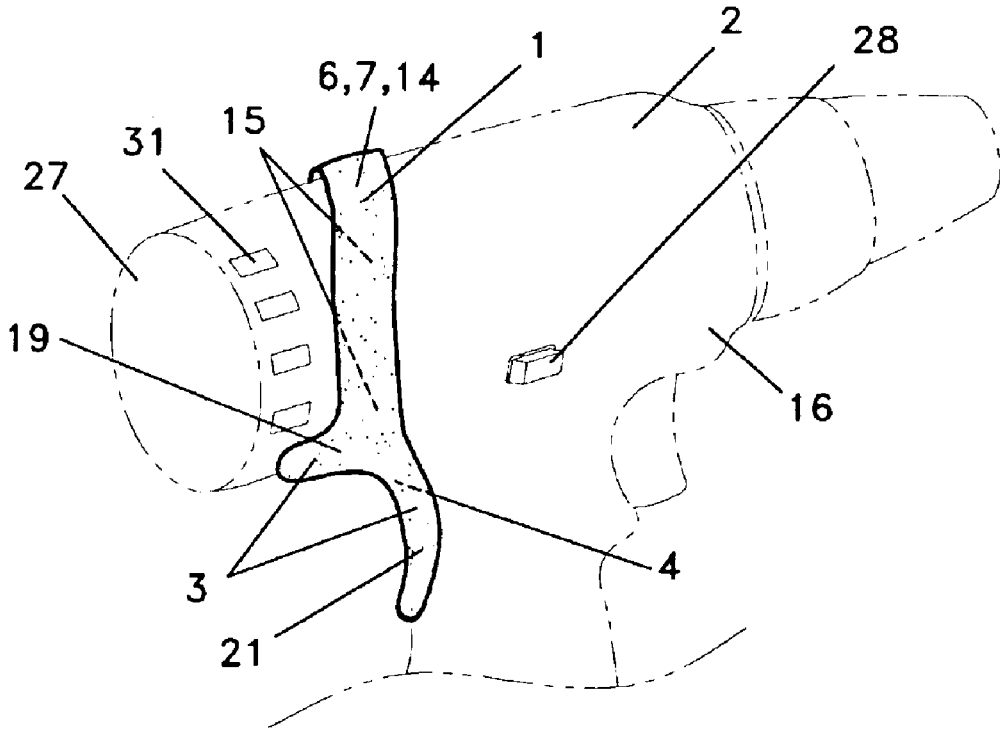
FIG. 16 is a perspective view of an embodiment of the invention showing its engaged configuration position on a cordless power drill during use.
Figure 17:
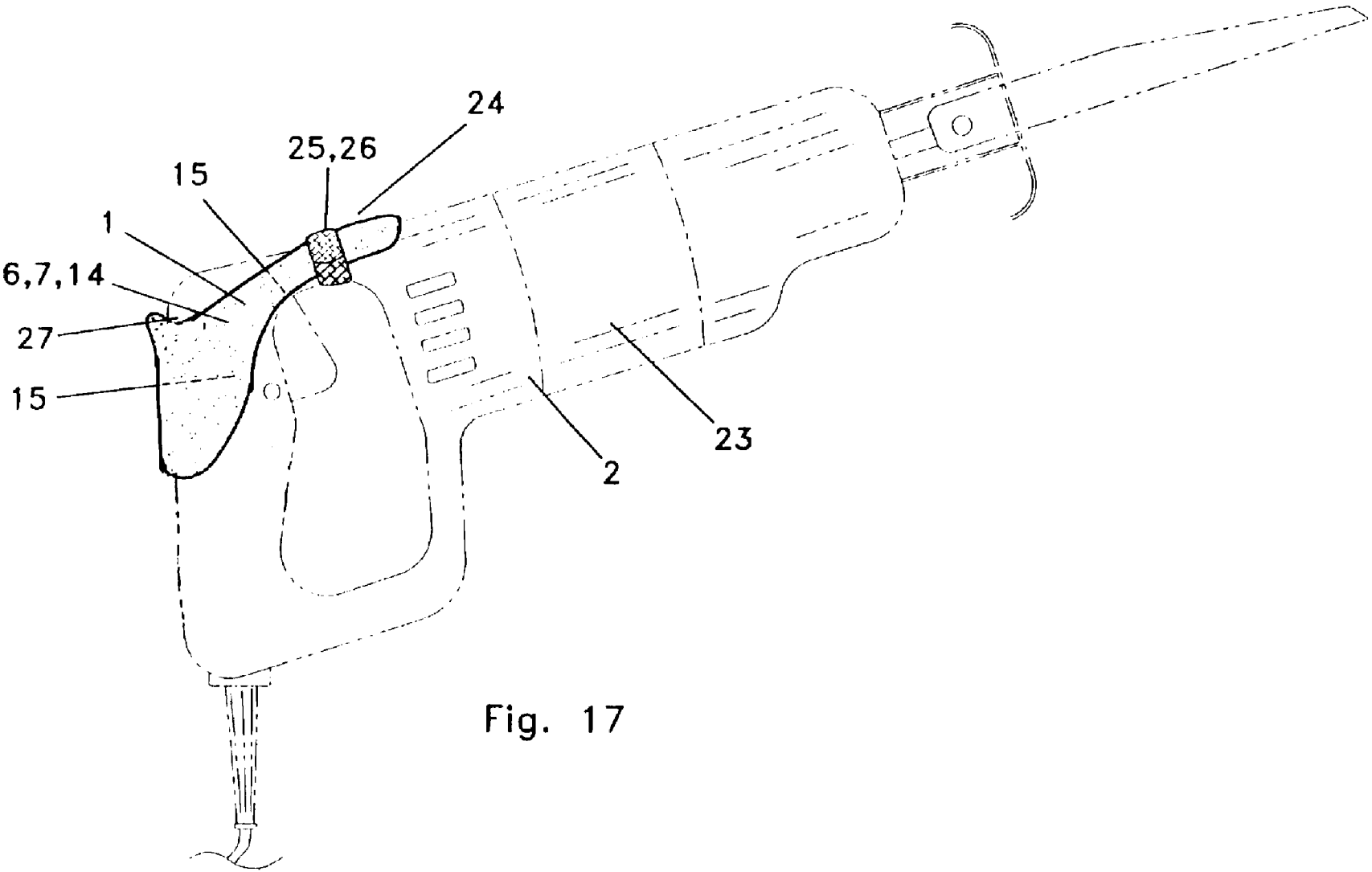
FIG. 17 is a perspective view of an embodiment of the invention showing its engaged configuration position on a reciprocating saw during use.

Referring to FIGS. 15–17, placement (or establishment) of the hand pressure abatement apparatus onto a power tool, and removal of the hand pressure abatement apparatus from the power tool, is quite simple. As mentioned earlier, an opening which may in at least one embodiment be arc-shaped, may create a retention band that may be slipped over a part of the power tool (such as a back end of the power tool—see, e.g., FIGS. 15–16) so as to retentively surround part of that power tool, thereby enabling retention of the hand pressure abatement apparatus onto the power tool and in a desired location. With respect to a power drill (including both corded and cordless power drills) placement may involve simply sliding the hand pressure abatement apparatus over the back or rear 27 of the power tool (in the figures, a power drill) so that the back end of the drill is moved (relative to the hand pressure abatement apparatus) through the opening. The retention band may be positioned in such a manner that it does not hinder the use of any switches or buttons 28 that may exist, such as the power switch or the forward/reverse button of the power tool (such as the power drill depicted in FIGS. 15 and 16). The retention band may also be narrow enough in width so as not to completely cover any motor vents 31 that may exist on the power tool and so as not to hinder the function of the power tool in any manner. In at least one embodiment, the opening (and therefore also the resultant retention band) is sized so that the part of the power tool that the retention band retentively surrounds is larger in cross-section than the retention band when non-deformed 32. In at least one embodiment, the user engageable, user disengageable retention element is elastic (as may be the case where the user engageable, user disengageable retention element is a retention band) and the retention is created upon elastic compression of the elastically deformed retention band around part of the power tool. In this way, the elastic properties of the padding and cover material may produce a snug fit of the user engageable, user disengageable retention element around part of the power tool, as well as producing a snug fit of the hand pressure abatement pad against the power tool surface as shown in FIGS. 15–17. The size of any opening that may exist may vary so as to accommodate different power tools (different size and type), although one specifically dimensioned pad with a specifically dimensioned opening may feasibly fit different power tools (different size and/or type). The result may be that there is no need for an additional attachment to the retention element, possibly enabling the benefit of even easier removal if desired. FIGS. 15–17 depict different views of the hand pressure abatement apparatus on a power tool.

Figure 12:
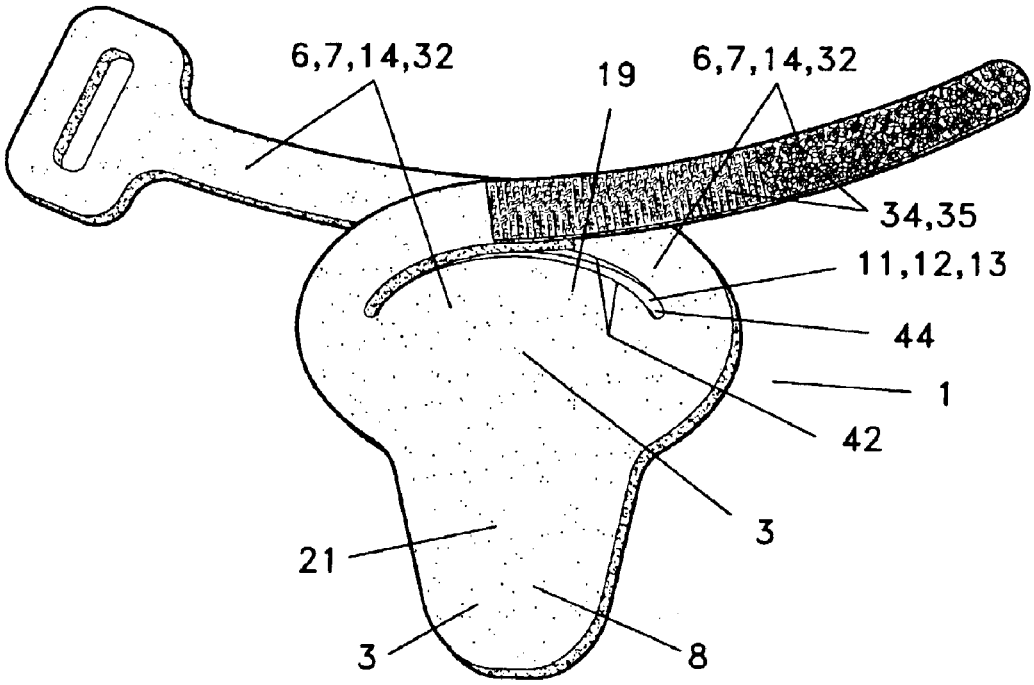
FIG. 12 is a front view of an embodiment of a hand pressure abatement apparatus in a disengaged configuration.
Figure 13:
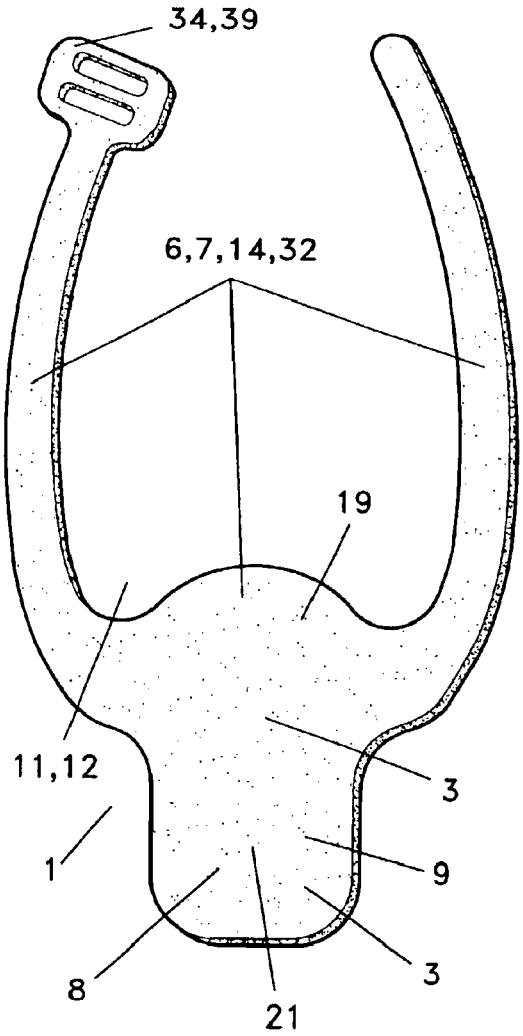
FIG. 13 is a front view of an embodiment of a hand pressure abatement apparatus in a disengaged configuration.
Figure 14:
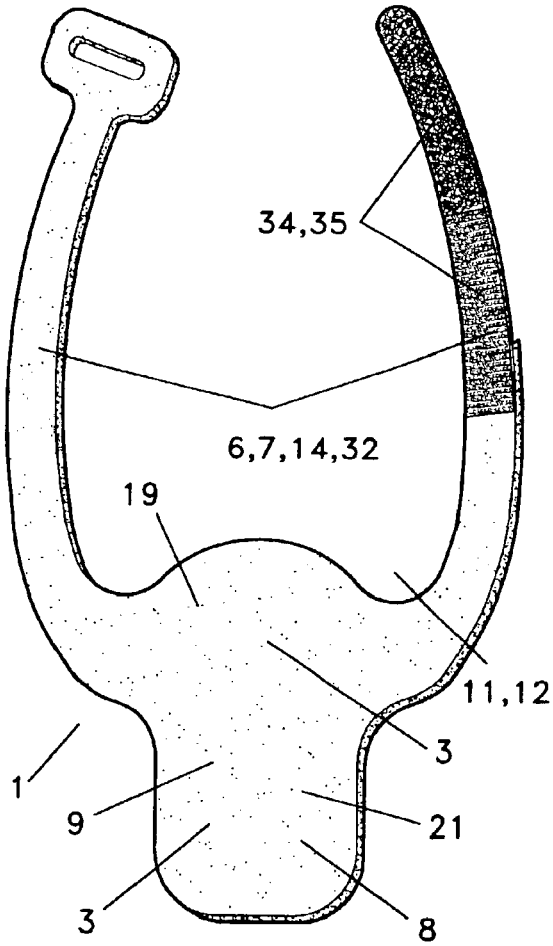
FIG. 14 is a front view of an embodiment of a hand pressure abatement apparatus in a disengaged configuration.

In at least one embodiment, the apparatus may comprise a discontinuous, user engageable, user disengageable retention element which may itself comprise a retention band attachment element 34, such as a Velcro strap 35, which may be connected with a terminal portion 36 of the discontinuous retention band (see FIGS. 12 and 14). Further, part of the retention band may be elastic 38. This elasticity, in combination with the Velcro strap(s), may provide the user with a convenient, secure manner of retaining the hand pressure abatement pad. In a separate embodiment(s), the retention band attachment element may instead be a type of buckle 39, e.g., and may not involve Velcro in any manner. Of course, any element that is usable to attach two terminal ends of a discontinuous, user disengageable, user engageable retention element so as to retentively surround or in other manner engage a part of a power or other tool may serve as a retention band attachment element.

Figure 3:
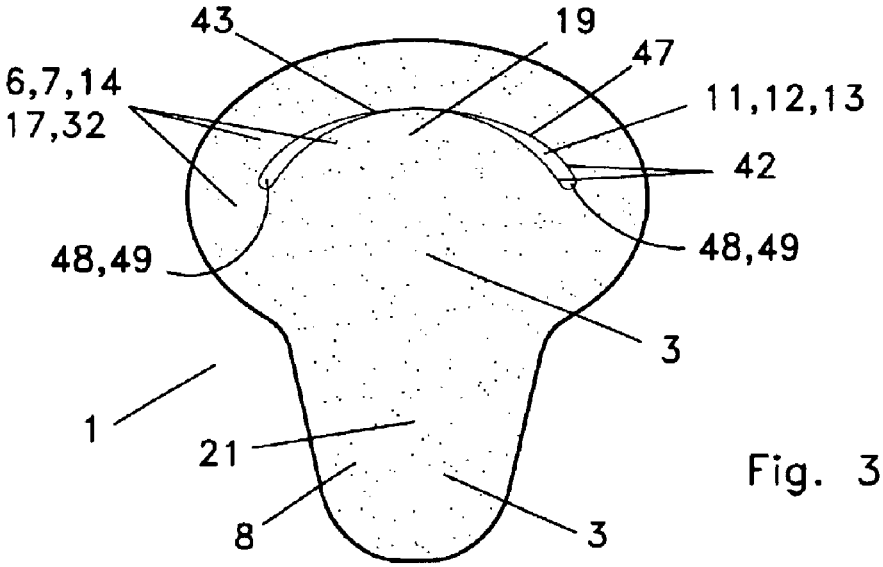
FIG. 3 is a front view of an embodiment of a hand pressure abatement apparatus in a disengaged configuration.
Figure 4:
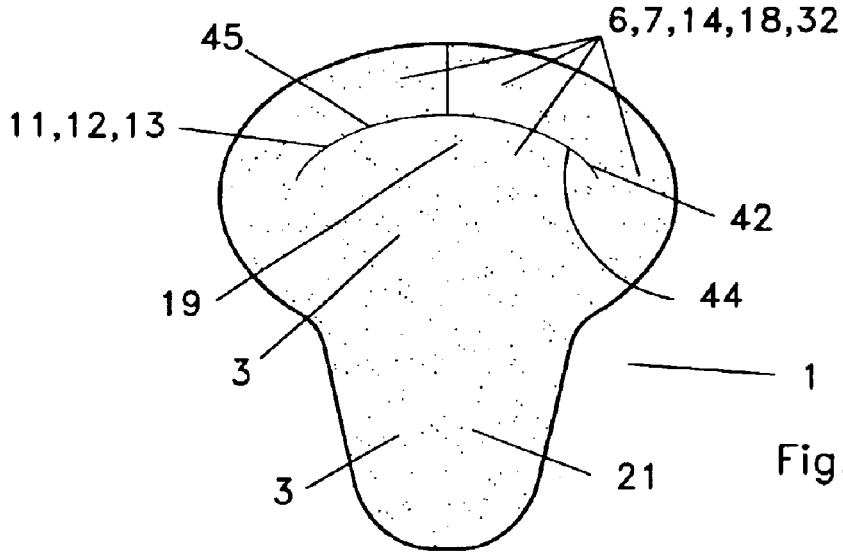
FIG. 4 is a front view of an embodiment of a hand pressure abatement apparatus in a disengaged configuration.
Figure 5:
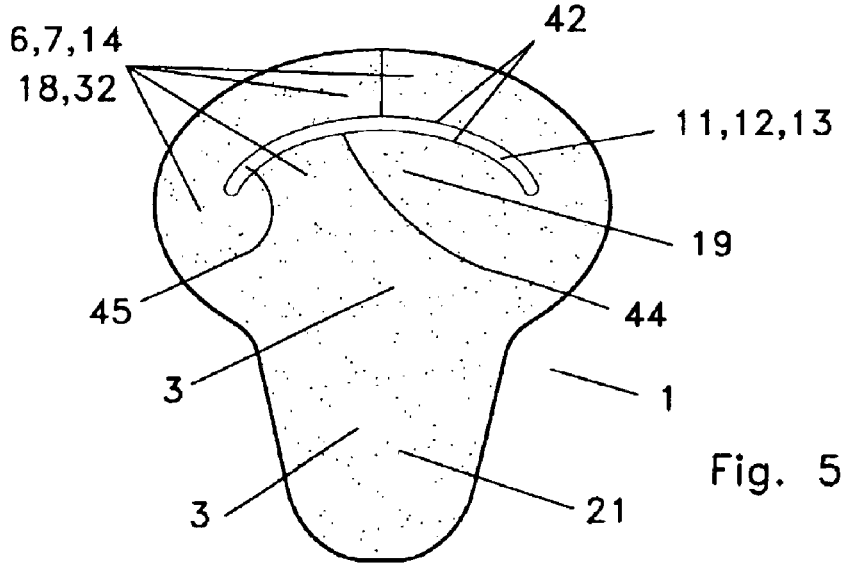
FIG. 5 is a front view of an embodiment of a hand pressure abatement apparatus in a disengaged configuration.
Figure 6:
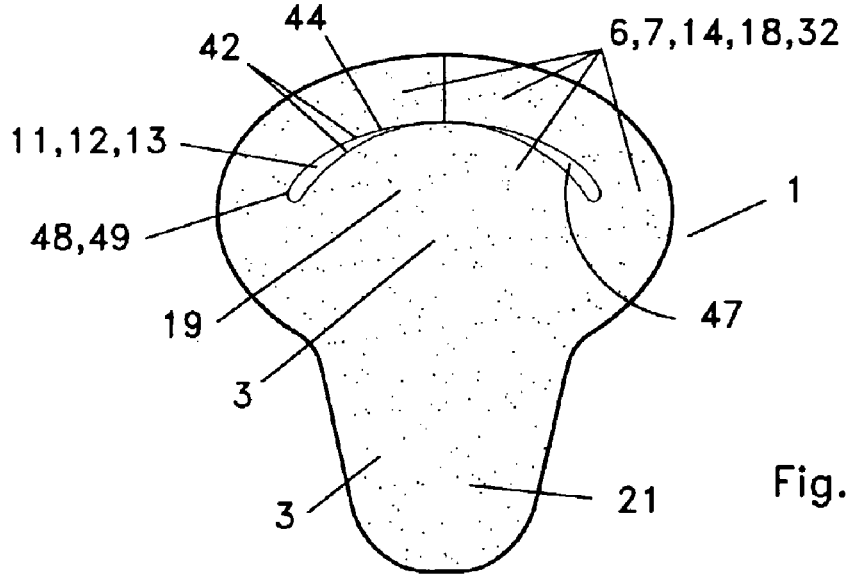
FIG. 6 is a front view of an embodiment of a hand pressure abatement apparatus in a disengaged configuration.
Figure 7:
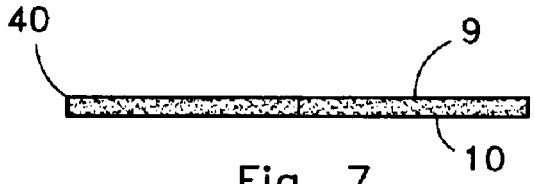
FIG. 7 is a top view of an embodiment of a hand pressure abatement apparatus in a disengaged configuration.
Figure 8:
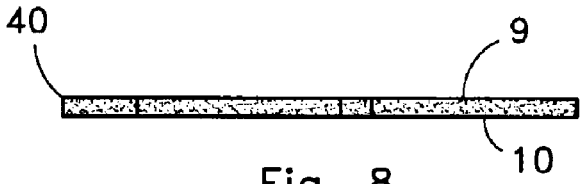
FIG. 8 is a side view of an embodiment of a hand pressure abatement apparatus in a disengaged configuration.
Figure 9:
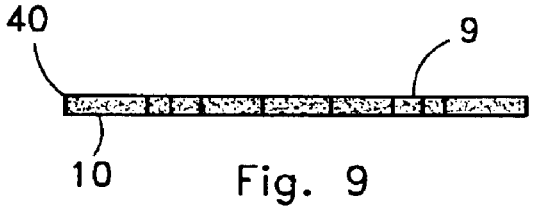
FIG. 9 is a bottom view of an embodiment of a hand pressure abatement apparatus in a disengaged configuration.
Figure 10:
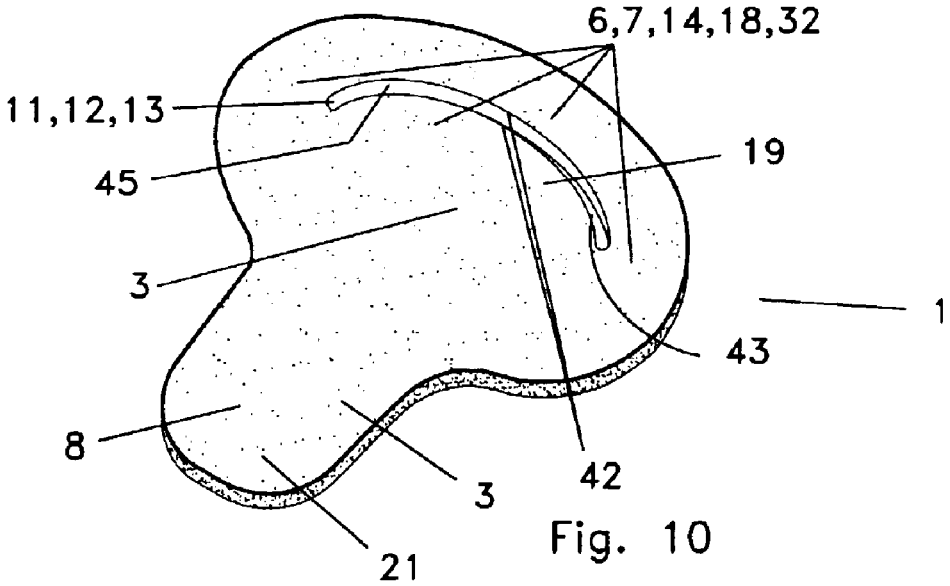
FIG. 10 is a perspective view of an embodiment of a hand pressure abatement apparatus in a disengaged configuration.
Figure 11:
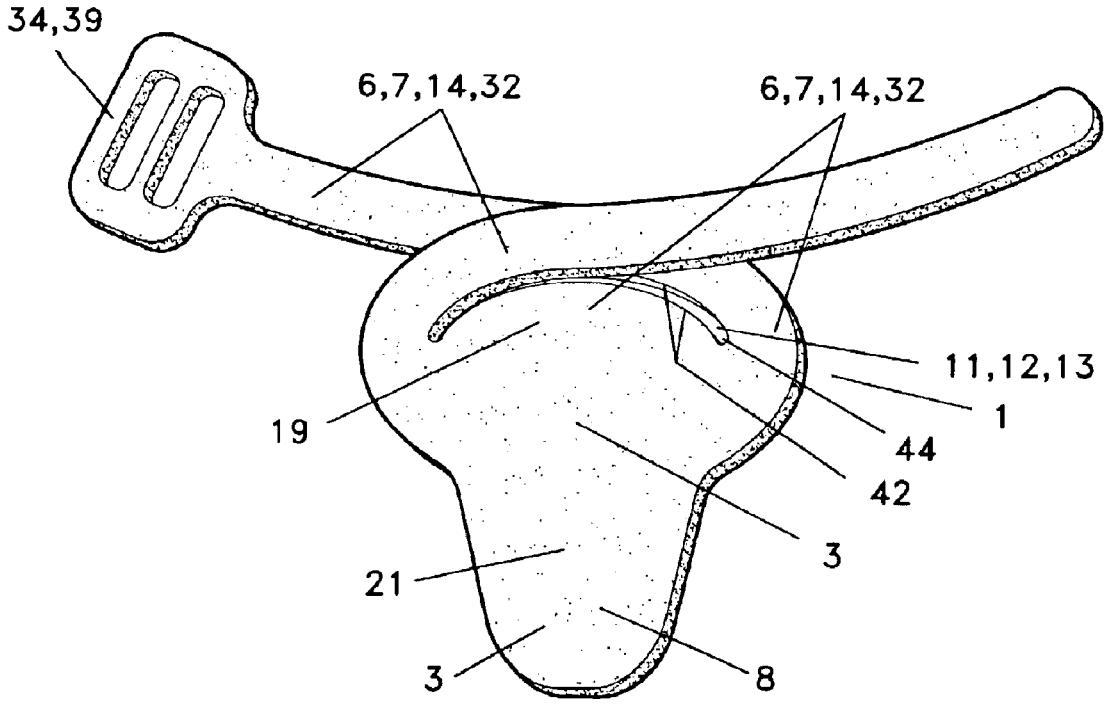
FIG. 11 is a front view of an embodiment of a hand pressure abatement apparatus in a disengaged configuration.

The hand pressure abatement apparatus may, upon disengagement of the retention element and removal of the apparatus from the power tool and placement on a flat surface or suspension from a single point on the apparatus, automatically reconfigure to a substantially planar shape 40 (see, e.g., FIGS. 1–6 and 10). Of course, as shown in FIGS. 1–6 and 10, the substantially planar shape may exhibit an arc-shaped opening that may define an interior edge 42 of the retention band, and in such manner may establish a retention band. This arc-shaped opening may be closed 43 (as in the case of a continuous retention band—see FIGS. 1–3), or open 44 (as in the case of a discontinuous retention band—see FIGS. 4–6). As shown in FIGS. 1, 2, 4 and 5, the arc-shaped opening may be of equal width 45 along its arc length. Instead, as shown in FIGS. 3 and 6, the arc-shaped opening may be of varying width 47 along its arc length, and, as shown in FIGS. 3 and 6, may have termina 48 that have tear drop shapes 49. Shaping the termina or ends of the opening in such a manner may afford enhanced tear resistance to the hand pressure abatement apparatus and enhances pad protection of at least one non-palm hand part (such as the proximal and/or distal thumb knuckle).

The end result may be a form-fitting pad that follows the contour of a power tool such as a drill and provides protection for the saddle of the thumb and forefinger with material, as well as for the palm. This hand pressure abatement apparatus may be applied to many different sizes and types of power tools, including may different sizes and types of drills, without significantly altering the basic shape and design of the invention. Of note is the fact that the hand pressure abatement apparatus may be engageable most securely with power tools that have a protruding section, such as a rear protruding section, so that at least a part of the protruding section (such as the front part of a rear protruding section) may enable secure retention upon engagement with the pad retention element (and without the need for a separate part that itself serves to retain the retention element). Essentially, secure retention of the pad without a separate "retention band retention element" may be enabled due to the fact that the protruding section may have a part that is substantially above the pad in an engaged configuration (so that, therefore, there will be less of a retention element slip inducing force). As stated, the hand pressure abatement apparatus may also be applied to other types of power tools where there may be a force (repetitive in nature or not) that is experienced by the hand or other body part (such as a shoulder) of the user that contacts the tool. This feature simplifies production which may result in a lower final cost for the consumer. Although the term power tool is emphasized throughout, the invention contemplates use on any tool or implement that, upon use, may impart forces to a contacting body part of the user.

It is important to understand that the above disclosure, although limited at times to power tool application and hand pressure abatement, is hereby to be construed as also disclosing a pressure abatement apparatus that is usable on other implements or tools whether electrically powered or not, and also as disclosing a pressure abatement apparatus that is usable to abate pressure experienced by contacting body parts other than a hand (such as a shoulder, or a foot, as but two examples. Indeed, all that may be needed for this inventive technology to have application is a tool or implement that is operated by a human user, that involves contact of a body part with the tool or implement and whose operation results in the human user experiencing some type of pressure or force at the contacting body part. Further, the application is hereby intended to provide disclosure for inventive method(s) that may, at times, be corollary to inventive apparatus disclosed above; said method claims (whether corollary to apparatus claims or not) may involve steps that may include establishing a certain part or element; adapting a certain part or element so that a desired result occurs; or enabling a certain result.

As can be easily understood from the foregoing, the basic concepts of the present invention may be embodied in a variety of ways. It involves both pressure abatement techniques as well as devices to accomplish the appropriate pressure abatement. In this application, the pressure abatement techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims in this non-provisional patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied on by the claims for this patent application. This patent application is designed to yield a patent covering numerous aspects of the invention both independently and as an overall system.

Further, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "retention element" should be understood to encompass disclosure of the act of "retaining"—whether explicitly discussed or not—and, conversely, were there effectively disclosure of the act of "retaining", such a disclosure should be understood to encompass disclosure of a "retention element" and even a "means for retaining." Such changes and alternative terms are to be understood to be explicitly included in the description.

Any acts of law, statutes, regulations, or rules mentioned in this application for patent; or patents, publications, or other references mentioned in this application for patent in, e.g., the attached information disclosure citation or statement, are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. However, as to each of the above, to the extent that such information or statements incorporated by reference might be considered inconsistent with the patenting of this/these invention(s) such statements are expressly not to be considered as made by the applicant(s).

Thus, the applicant(s) should be understood to claim at least: i) each of the cushioning devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, and ix) methods and apparatuses substantially as described hereinbefore and with reference to any of the accompanying examples, x) the various combinations and permutations of each of the elements disclosed, and xi) each potentially dependent claim or concept as a dependency on each and every one of the independent claims or concepts presented. In this regard it should be understood that for practical reasons and so as to avoid adding potentially hundreds of claims, the applicant may eventually present claims with initial dependencies only. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

The claims set forth in this specification by are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A hand pressure abatement apparatus usable on a power tool, said hand pressure abatement apparatus comprising:

a hand pressure abatement pad adapted for placement on a power tool surface so that during operation of said power tool, said hand pressure abatement pad is established between said power tool surface and at least a portion of a power tool operator's hand; and an elastic, user engageable, user disengageable retention element to which said hand pressure abatement pad is responsive and that enables:

(a) disengageable retention of said hand pressure abatement pad on said power tool surface during operation of said power tool, and (b) complete retention of said hand pressure abatement pad on said power tool by only one retention band surrounding a part of said power tool, wherein said hand pressure abatement pad is:

(c) unitary; and (d) adapted to abate pressure experienced by both:

(i) an upper part of the saddle of the thumb and forefinger; and (ii) the palm of said power tool operator's hand, wherein said user engageable, user disengageable retention element comprises a retention band adapted to retentively surround a part of said power tool, wherein said hand pressure abatement apparatus is automatically reconfigurable to a substantially planar shape upon removal from said power tool, and wherein said substantially planar shape exhibits an arc-shaped opening that establishes said retention band.

2. A hand pressure abatement apparatus as described in claim 1 wherein said arc-shaped opening comprises a closed arc-shaped opening.

3. A hand pressure abatement apparatus as described in claim 1 wherein said arc-shaped opening comprises an open arc-shaped opening.

4. A hand pressure abatement apparatus as described in claim 2 or 3 wherein said arc-shaped opening is of varying width along its arc length.

5. A hand pressure abatement apparatus as described in claim 4 wherein termina of said arc-shaped opening have tear drop shapes.

6. A power tool operator hand pressure abatement method comprising the steps of:

obtaining a cushioning material to create a hand pressure abatement pad usable to abate pressure received by a power tool operator's hand;

adapting said hand pressure abatement pad for placement on a power tool surface so that during operation of said power tool, said hand pressure abatement pad is established between said power tool surface and at least a portion of said power tool operator's hand;

establishing a user engageable, user disengageable retention element to which said hand pressure abatement pad is responsive; and enabling both:

(a) disengageable retention of said hand pressure abatement pad on said power tool surface, and (b) complete retention of said hand pressure abatement pad on said power tool surface by surrounding a part of said power tool with only one retention band through said user engageable, user disengageable retention element, wherein said hand pressure abatement pad is usable with a power drill and at least one other type of power tool, wherein said step of establishing a user engageable, user disengageable retention element comprises the step of establishing a retention band and adapting said retention band to retentively surround a part of said power tool, wherein said step of creating a hand pressure abatement pad comprises the step of creating a hand pressure abatement pad that, upon user disengagement of said user engageable, user disengageable retention element and removal of said hand pressure abatement pad from said power tool surface, automatically reconfigures so as to lie in substantially the same plane as that plane into which said user engageable, user disengageable retention element reconfigures upon user disengagement of said user engageable, user disengageable retention element, and wherein said step of adapting said retention band to retentively surround said power tool comprises the step of establishing a closed or an open arc-shaped opening that is of varying width along its arc length and whose termina have tear drop shapes.

* * * * *